US006921329B2

(12) United States Patent
Riello

(10) Patent No.: US 6,921,329 B2
(45) Date of Patent: Jul. 26, 2005

(54) AIR-DISTRIBUTION CAP FOR A CONVECTOR

(75) Inventor: Valerio Giordano Riello, Bevilacqua (IT)

(73) Assignee: Aermec S.p.A., Bevilacqua (IT)

( * ) Notice: Subject to any disclaimer, the term of this patent is extended or adjusted under 35 U.S.C. 154(b) by 0 days.

(21) Appl. No.: 10/665,629

(22) Filed: Sep. 22, 2003

(65) Prior Publication Data

US 2004/0072537 A1 Apr. 15, 2004

Related U.S. Application Data

(63) Continuation of application No. PCT/IT01/00137, filed on Mar. 20, 2001.

(51) Int. Cl.[7] ..... F24F 7/00
(52) U.S. Cl. ..... 454/318; 454/69; 62/408
(58) Field of Search ..... 454/318, 69, 305, 454/307; 62/408, 404

(56) References Cited

U.S. PATENT DOCUMENTS

| | | | | | |
|---|---|---|---|---|---|
| 3,648,592 | A | * | 3/1972 | Nieboer | 454/154 |
| 4,341,150 | A | * | 7/1982 | McConnell et al. | 454/135 |
| 4,535,685 | A | * | 8/1985 | Reuter | 454/299 |
| 4,653,386 | A | * | 3/1987 | Hayakawa et al. | 454/316 |
| 4,782,999 | A | * | 11/1988 | Ishii et al. | 236/49.3 |
| 5,093,895 | A | * | 3/1992 | Ghorayeb | 392/395 |
| 5,105,630 | A | * | 4/1992 | Kim | 62/285 |
| 5,194,043 | A | * | 3/1993 | Takahashi et al. | 454/316 |
| 5,771,708 | A | * | 6/1998 | Suzuki et al. | 62/285 |
| 5,878,591 | A | * | 3/1999 | Tsuji et al. | 62/285 |
| 5,924,923 | A | * | 7/1999 | Chiguchi et al. | 454/256 |
| 6,196,018 | B1 | * | 3/2001 | Mori et al. | 62/404 |

FOREIGN PATENT DOCUMENTS

| | | |
|---|---|---|
| EP | 0 962 721 A3 | 12/1999 |
| EP | 0 962 721 A2 | 12/1999 |
| EP | 0 989 374 A3 | 3/2000 |
| EP | 0 989 374 A2 | 3/2000 |

* cited by examiner

*Primary Examiner*—Derek S. Boles
(74) *Attorney, Agent, or Firm*—Rothwell, Figg, Ernst & Manbeck

(57) ABSTRACT

The present invention relates to an air-distribution cap which is to be fitted on top of a heating or air-conditioning unit with natural or forced convection and the function of which is to regulate both the flow-rate and the direction of the air output by the convector. In particular, the present invention relates to a cap (1) for distributing the air output by a heating or air-conditioning unit with forced convection or with natural convection, characterized in that it comprises a deflector (3, 103) having one or more vanes (13, 113), each vane being orientable so as to adopt a position in which it is inclined to the vertical so that its outer end faces towards the wall against which the unit is fitted.

15 Claims, 4 Drawing Sheets

AIR-DISTRIBUTION CAP FOR A CONVECTOR

CROSS REFERENCE TO RELATED APPLICATIONS

This application is a Continuation of PCT International Application Number PCT/IT01/00137, filed on Mar. 20, 2001.

BACKGROUND OF THE INVENTION

The present invention relates to an airdistribution cap which is to be fitted on top of a heating or air-conditioning unit with natural or forced convection and the function of which is to regulate both the flow-rate and the direction of the air output by the convector.

Heating units normally used for domestic or office heating comprise a finned heat-exchanger with a pipecoil for the circulation of hot water-connected to the heating system of the habitable unit—and a housing with openings at the bottom and at the top for promoting the circulation of air into the unit and through the finned exchanger.

There are two types of such heating units: units with natural convection and units with forced convection (fan convectors). In fan convectors, a fan is disposed beneath the finned exchanger and creates forced air convection extremely efficiently. In natural-convection units, on the other hand, the air-flow is caused by movements present in the fluid mass owing to disequilibria of forces caused by the heat-transmission process. When the exchanger is supplied with hot water, convection is initiated owing to the pressure difference existing between the column of still, cold air outside the convector and the column of hot air present inside the convector, so that a true chimney effect is created.

It is also known to cover conventional thermosiphonic heaters or radiators with suitable housings both to improve their appearance and to prevent dispersal of heat in directions which are not useful from the point of view of the habitability of the room.

For this purpose, the housings or cabinets have front grills which enable the hot air-flow to be directed towards the centre of the room, thus minimizing dispersal and making best use of the heat supplied by the thermosiphonic heater or radiator. A disadvantage of this solution, which is particularly clear when the heating unit is placed beneath a window, is that the hot air-flow, which is directed forwards, cannot substantially strike the surface of the window. When the window is misted over-which normally occurs when the humidity inside the dwelling is very high and/or the outside temperature is low—a heating unit such as that described above cannot therefore demist the glass.

A first problem underlying the present invention is therefore that of providing a distribution device which can be fitted on thermosiphonic heaters, radiators, or heating or air-conditioning units with natural convection or with forced convection and which does not have the disadvantages discussed above.

A further problem towards which the present invention is directed is that relating to the need to regulate the heating power delivered by the heating unit at will, in dependence on specific environmental requirements. This operation which, in the case of fan convectors, is performed simply by switching the fan on or off, can be achieved with thermosiphonic heaters, with radiators, or with natural-convection units, only by intermittent operation of the thermosiphonic circulation of hot water.

A third problem addressed by the present invention is that of providing a device characterized by considerable constructional simplicity and versatility of use.

SUMMARY OF THE INVENTION

The problems set out above are overcome by an air-distribution cap comprising a deflector having one or more vanes, each vane being orientable so as to adopt a position in which it is inclined to the vertical so that its outer end faces towards the wall against which the unit is fitted.

BRIEF DESCRIPTION OF THE DRAWINGS

Further characteristics and advantages of the airdistribution cap of the present invention will become clearer from the description of some preferred embodiments given by way of non-limiting example below with reference to the appended drawings, in which.

DESCRIPTION OF THE PREFERRED EMBODIMENT

Figure 1:
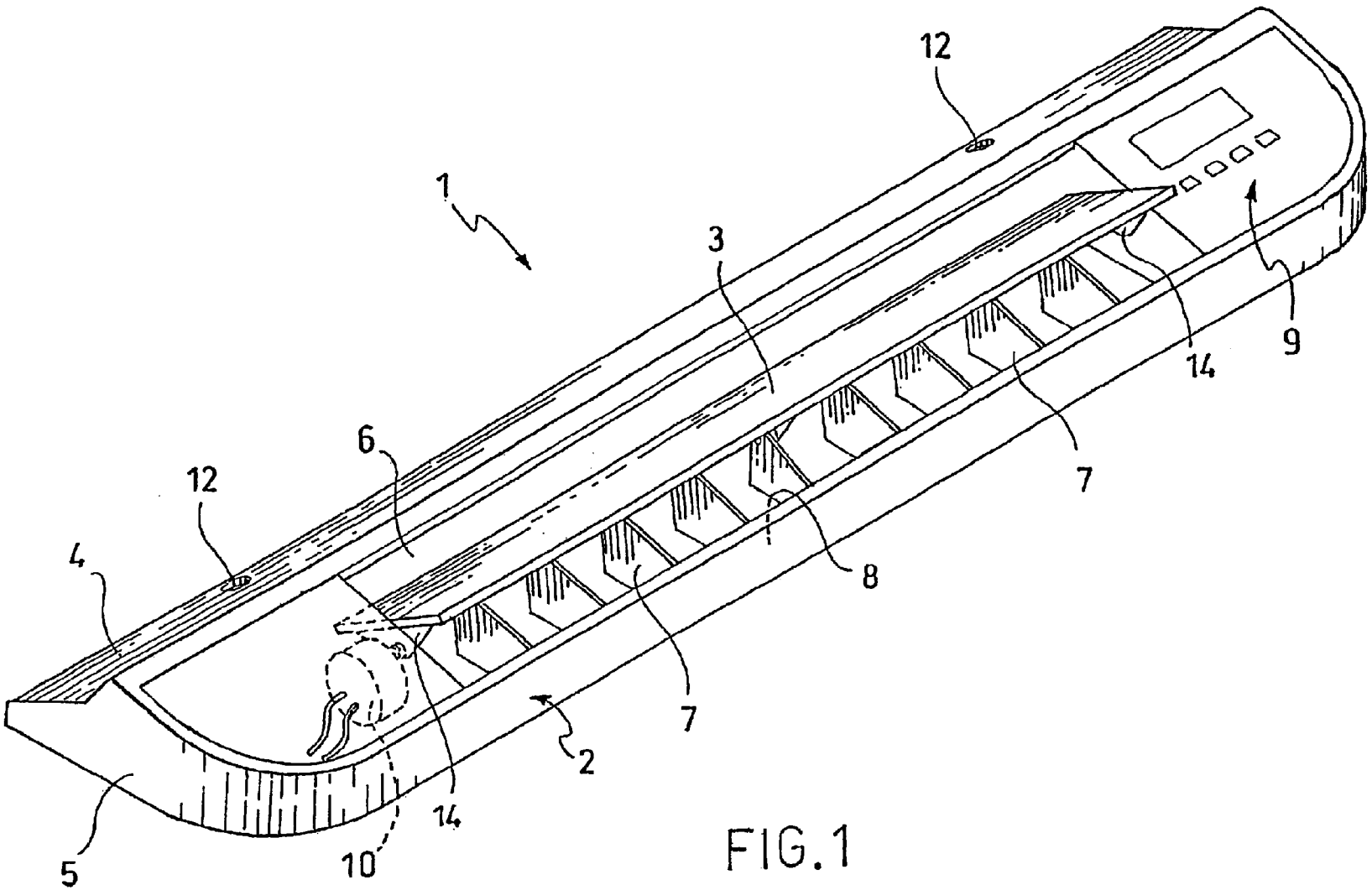
FIG. 1 is a perspective view of the airdistribution cap according to the present invention.

The air-distribution cap according to the present invention will now be described with reference to the appended drawings. As shown in FIG. 1, the distribution cap, generally indicated 1, comprises a frame 2 which supports a deflector 3 in a pivotable manner.

The frame 2 is open at the bottom and comprises, at the top, a rear portion 4 which is intended to face the wall on which the heating unit is mounted, and a front portion 5 having a substantially rectangular opening 6 which houses the deflector 3.

Figure 2:
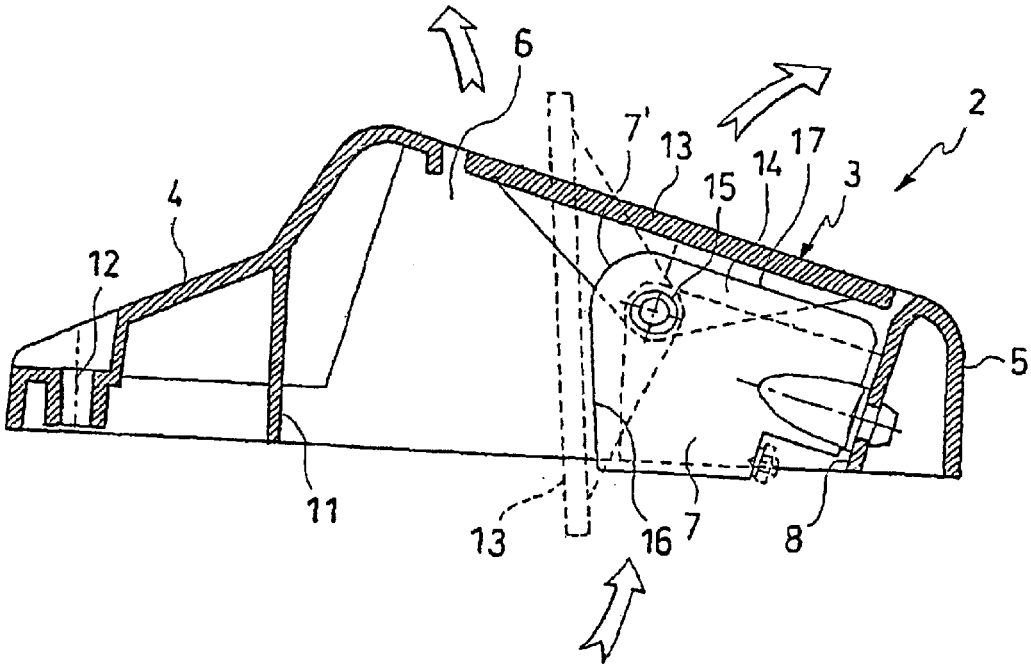
FIG. 2 is a side view showing the cap of FIG. 1 in section.

Inside the opening 6 in the frame 2 there is a plurality of parallel fins 7 lying in planes perpendicular to the longitudinal axis of the distribution cap 1. The fins 7, the function of which is to direct the hot air output by the convector, are fixed by known fixing means (such as, for example, a male-andfemale screw system, as shown in FIG. 2) to the inner side of the front wall 8 of the frame 2 and project therefrom, towards the interior of the opening 6, approximately as far as its centreline. Alternatively, the fins 7 are articulated for pivoting on the front wall 8 so as to be orientable. In this case, a suitable conventional electrical or manual control will provide for the movement of the fins.

The fins 7, which have a substantially irregular polygonal shape, have corners 7'-formed by the inner side 16 and the upper side 17 of the fin—which are greatly rounded.

For a natural-convection heating unit the set of fins 7 will advantageously not be provided inside the device since, with the low speeds which are reached by the air in the output opening, it is difficult to orient its flow horizontally; their presence could therefore cause an excessive loss of pressure of the hot air output by the convector.

The front portion 5 of the frame 2 houses a control panel 9 of the heating unit, operatively connected in known and conventional manner to an electrical actuator 10 which brings about the pivoting movement of the deflector 3 and, in the case of a fan convector, to the fan which activates the forced convection of the hot air. In an alternative and less expensive embodiment, the electrical actuator 10 is replaced by a manual actuator (not shown in the drawings) such as, for example, a conventional wheel for controlling the deflector 3. In a further embodiment, the opening and the closure of the deflector can be achieved, again manually, by acting on it directly and thus without the need to provide a control wheel.

As shown in FIG. 2, the front portion 5 and the rear portion 4 of the frame 2 are separated by a panel 11. Through-holes 12 are formed in the rear portion 4 of the frame 2 for housing means (in particular a screw) for the fixing of the device of the invention to the top of a convector housing. In other embodiments, the holes 12 may be replaced by other known fixing means such as, for example, means for snap-engagement on the convector housing.

As shown in FIG. 2, the deflector 3 comprises a vane 13 of a shape and size substantially corresponding to those of the opening 6 so that it blocks this opening when the deflector is in the closed position. One or more flat projections 14 are disposed on the lower surface of the vane 13. These projections 14, which lie in planes perpendicular to the longitudinal axis of the deflector 3, are articulated for pivoting on the inner side walls of the opening 6 and/or on one or more fins 7. For a deflector with a high length/width ratio, the articulation of the deflector to a fin or fins is to be recommended, as reinforcement. Naturally, in this case, the fin 7 to which the deflector is connected, will not be orientable.

The electrical actuator 10 (for example, a stepper motor) or a manual actuator as described above, is connected in known manner—for example by means of a transmission shaft—to one of the articulation points 15, preferably to an end articulation, so that the pivoting of the deflector can be controlled from the exterior.

The point 15 at which a projection 14 is articulated to a fin 7 is disposed in the vicinity of the rounded corner 7' of the fin. Interference does not therefore take place between the vane 13 and the fins 7 when the deflector 3 pivots about the articulation. The deflector 3 is in fact shown in the fully open position in broken outline in FIG. 2. In this position, the vane 13 is in abutment with the inner side 16 of the fin, which thus acts as a stop.

Figure 3:
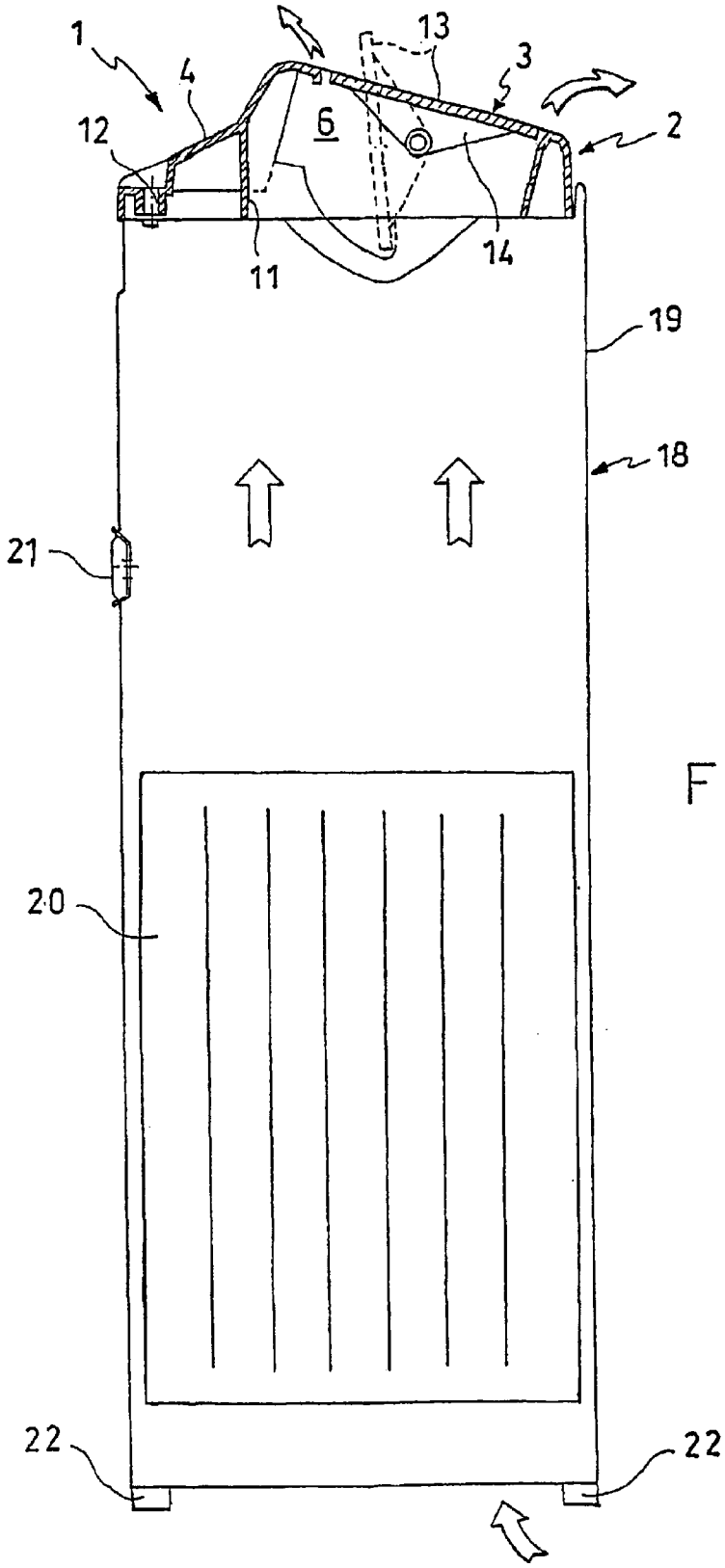
FIG. 3 is a side view showing, in section, a natural-convection heating unit comprising the distribution cap according to the present invention.

FIG. 3 shows the air-distribution device according to the invention mounted on a naturalconvection heating unit 18. This heating unit or convector comprises a housing 19 which is open or partially open at the bottom so that cold air can enter from the surrounding environment. The housing 19 houses a heat exchanger 20 shown schematically in the drawing.

The exchanger 20, which is wholly conventional, will comprise a pipe-coil which is connected in a recirculation arrangement to the heating system of the dwelling, and the tubing of which extends through a series of perforated fins, the whole constituting a so called finned assembly the function of which is to promote thermal exchange. Suitable valves or systems may also be provided for the operation and control of the flow of heating water. Alternatively, the exchanger 20 will be a normal thermosiphonic exchanger or radiator, for example, of the cast-iron, steel or aluminum type.

The housing 19 will also comprise one or more seats 21 for means for fixing the unit to the wall, and/or feet 22. The feet 22 may have dimensions such as to conceal any water-supply pipes which may reach the unit through the floor. Clearly, however, the base of the housing must be raised from the floor to allow air to circulate into the convector.

As shown in FIG. 3, in this embodiment, the distribution cap 1 does not have the fins 7 so as not to cause a drop in the flow-rate of the air output. The deflector 3 will therefore be articulated, solely at its two ends, to the cap itself.

Figure 4:
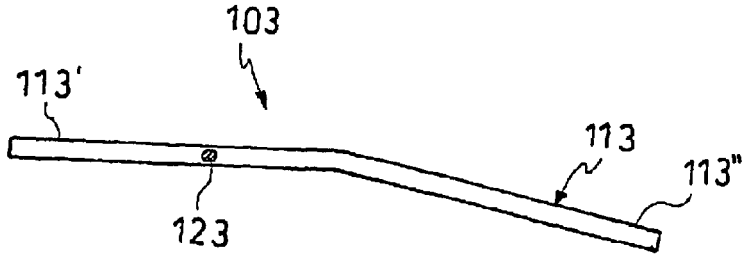
FIG. 4 is a side view of the deflector of the cap according to a second embodiment of the invention.
Figure 5:
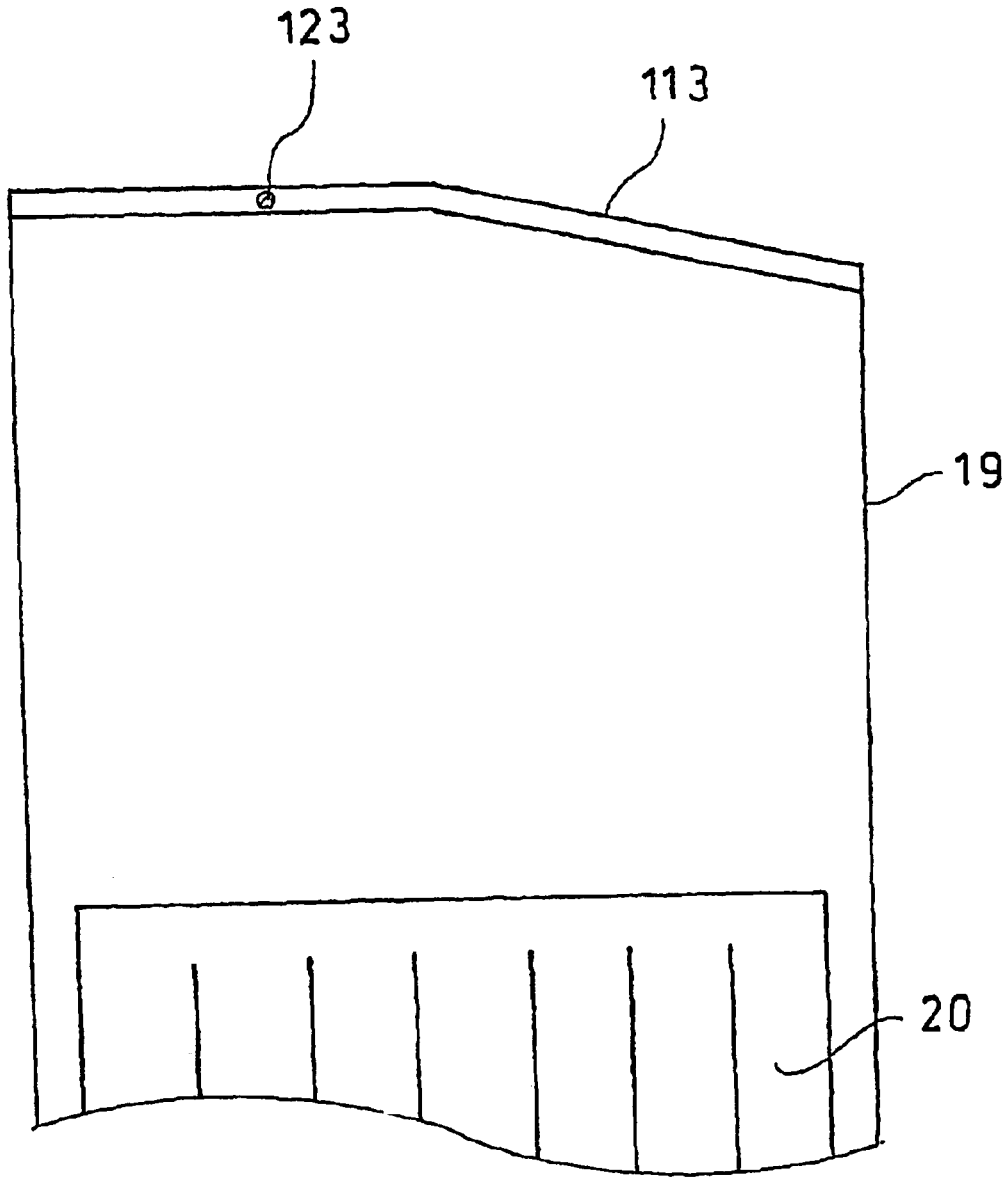
FIG. 5 is a side view showing, in section, a detail of the heating or air-conditioning unit according to a possible application of the deflector of FIG. 4.

In the embodiment shown in FIGS. 4 and 5, the vane 113 of the deflector 103 is shaped like a roof with two slightly inclined pitches 113', 113". The angle formed between the two pitches will be preferably about 168. This particular shape allows the hot air output by the convector to be directed better, as will be described further below.

Two pins 123 (only one of which is shown, the other being positioned correspondingly on the opposite side) project from the side edges of one of the two pitches 113' and are intended to be housed for pivoting in respective seats disposed on the side walls of the opening 6. These pins 123 constitute the articulation points of the deflector 103. The pins 123 are preferably positioned approximately one third of the distance across the width of the pitch 113' from the ridge line between the two pitches. As shown in FIG. 5, the deflector 103 may also be mounted directly on the upper edges of the housing of the heating or airconditioning unit. These edges of the housing must therefore be suitably shaped as shown in the drawing and the holes for housing the pins 123 will be formed in their side walls.

The air-distribution cap according to the present invention may be made either of metal or of plastics material. This latter material is particularly advantageous in terms of the cost of the device.

The operation of the air-distribution cap according to the present invention will now be described, again with reference to the drawings.

As stated above, the cap 1 may be mounted, for example, by means of a male-and-female screw system, on the top of the housing of a heating unit with forced convection or with natural convection, of which the latter may be in the form of a cabinet housing a conventional thermosiphonic heater or radiator. The cap 1 of the invention will therefore be mounted in place of the closure top of this unit. For natural-convection units, the distribution cap will preferably be of the type without fins 7. The deflector 3,103 is pivoted about its articulation to the desired extent of opening by an electrical control acting on the electrical actuator 10 or by a manual control. With manual operation, the deflector is held in the stopping position by known stop means or by suitable counterweights. These devices are widely known to a person skilled in the art and will not therefore be described in greater detail. With an electrical actuator, the desired position will be maintained by the actuator itself (for example, by the stepper motor).

The deflector can pivot to a position in which, having passed through the vertical position, it is slightly inclined with its outer end facing towards the wall against which the convector is fitted. In a cap 1 with fins, the fact that the inner side 16 of the fin 7 is slightly inclined, that is, that the angle formed between that side and the upper side 17 is less than 90, means that the vane 13 can adopt the abovedescribed position in which it is inclined to the vertical. By virtue of the particular orientability of the above-described vane, some of the air output from the heating unit is directed towards the wall and hence towards any window disposed above it, as indicated by the arrows in FIGS. 2 and 3. If the cap 1 has the deflector 113 with the roof-shaped vane, it can easily be seen that the air output is directed towards the wall by the first pitch 113' whereas the second pitch 113" favours a fan-shaped opening for the air-flow which thus creates a thicker cushion of hot air in the vicinity of the window disposed above it.

The deflector 3,103 can be adjusted to any position between the fully-closed position and the fully-open position which, naturally, will be the preferred position when it is necessary to demist the glass of any window disposed above the heater or in any case to obtain the maximum heating power of the unit.

If the room is overheated, however, the deflector can be fully closed to as to block the air-outlet opening 6.

The advantages of the air-distribution cap according to the present invention are clear from the foregoing description.

In the first place, the cap 1 constitutes an accessory which can easily be fitted on convectors with forced or natural convection, for example, on alreadyinstalled conventional thermosiphonic heaters or radiators.

Moreover, its constructional simplicity which is due, in particular, to the presence of a single vane 13, 113 in the deflector, is reflected in a low cost which renders the distribution cap according to the invention also advantageous for use in the least expensive heating units.

A substantial advantage of the cap according to the present invention is that the deflector 3,103 can be oriented so as to adopt an inclined position facing towards the wall and any window disposed above it so as to direct the hot-air flow towards glass misted over by water vapour and to promote quick and efficient demisting thereof.

With the air-distribution cap according to the present invention, effective adjustment of the amount of air output from the convector and hence accurate regulation of the heating power of the heating unit are achieved. This is particularly advantageous in naturalconvection units, particularly in conventional thermosiphonic systems in which heat regulation is normally achieved by interrupting the thermosiphonic circulation of the hot water, with the risk of the creation of air bubbles in the system. With the device of the invention, however, the heating of the room can be interrupted at will simply by adjusting the deflector to the closed position.

Naturally only some specific embodiments of the air-distribution cap according to the present invention have been described, but a person skilled in the art may apply thereto all modifications necessary for their adaptation to particular applications without, however, departing from the scope of protection of the present invention.

For example, the opening and the closure of the deflector 3,103 may be brought about automatically by means of a central control unit connected to a thermostat adjusted to a predetermined temperature. An example of automatic regulation by means of a thermostat is that defined in the European patent application which was published under the No. EP 0 837 288 on 22, Apr. 1998 in the name of the applicant of the present patent application and the description of which is incorporated herein by reference.

Moreover, the cap 1 may also be adapted to airconditioning units or to units operating both as coolers and as heaters.

The heating unit with the air-distribution cap according to the present invention may also be mounted on the ceiling. In this case, the use of a deflector 103 with a roof-shaped vane 113 will enable the air to be directed better towards the interior of the room.

Naturally, although the above-described embodiment with a single vane is the preferred embodiment of the present invention, the deflector 3,103 may also comprise two or more vanes.

What is claimed is:

1. A cap for distributing an air flow output by a heating or conditioning unit with forced or natural convection in a vertical direction, the unit having a housing with an upper end and a base and being of the type to be mounted against a vertical wall, the cap comprising a frame with a top provided with a rear portion which is intended to face the vertical wall against which the unit is mounted, a front portion having a substantially rectangular opening, and deflector means located in said opening, the deflector means being angularly displaceable around a longitudinal axis extending parallel to said vertical wall, from a closure position for closing said substantially rectangular opening and an open position, the deflector means having an inner surface which, in said closed position, faces inside the unit, and an opposed outer surface, wherein, in the open position, the deflector means is inclined to the vertical direction of the air flow so that the outer surface of the deflector means is turned towards the wall against which the unit is mounted, whereby a portion of the air flow output from the unit is directed towards the vertical wall.

2. A cap according to claim 1 wherein said deflector means are in form of a vane.

3. A cap according to claim 1 wherein said deflector means are electilcally operated.

4. A cap for distributing an air flow output by a heating or conditioning unit with forced or natural convection in a vertical direction, the unit having a housing with an upper end and a base and being of the type to be mounted against a vertical wall, the cap comprising a frame with a top provided with a rear portion which is intended to face the vertical wall against which the unit is mounted, a front portion having a substantially rectangular opening, and a deflector vane located in said opening, the deflector vane being angularly displaceable around a longitudinal axis extending parallel to said vertical wall, from a closure position for closing said substantially rectangular opening and an open position, the deflector vane having an inner surface which, in said closed position, faces inside the unit, and an opposed outer surface, wherein, in the open position, the deflector vane is inclined to the vertical direction of the air flow so that the outer surface of the deflector vane is turned towards the vertical wall against which the unit is mounted, whereby a portion of the air flow output from the unit is directed towards the vertical wall, a plurality of parallel fins being provided inside said opening of said front portion, said fins lying in planes perpendicular to said longitudinal axis.

5. A cap according to claim 4 wherein the deflector vane is roof-shaped with two inclined pitches.

6. A heating or air-conditioning unit with forced convection or with natural convection comprising an air flow distribution cap according to claim 1.

7. A heating or air-conditioning unit with forced convection or with natural convection comprising an air flow distribution cap according to claim 2.

8. A heating or air-conditioning unit with forced convection or with natural convection comprising an air flow distribution cap according to claim 3.

9. A heating or air-conditioning unit with forced convection or with natural convection comprising an air flow distribution cap according to claim 4.

10. A heating or air-conditioning unit with forced convection or with natural convection comprising an air flow distribution cap according to claim 5.

11. A cap according to claim 1, wherein the frame of the cap has a bottom, said bottom being open and connectible to said upper end of the housing of said unit.

12. A cap according to claim 2, wherein the frame of the cap has a bottom, said bottom being open and connectible to said upper end of the housing of said unit.

13. A cap according to claim 3, wherein the frame of the cap has a bottom, said bottom being open and connectible to said upper end of the housing of said unit.

14. A cap according to claim 4, wherein the frame of the cap has a bottom, said bottom being open and connectible to said upper end of the housing of said unit.

15. A cap according to claim 5, wherein the frame of the cap has a bottom, said bottom being open and connectible to said upper end of the housing of said unit.

* * * * *